US006602084B2

(12) United States Patent
Sagano et al.

(10) Patent No.: US 6,602,084 B2
(45) Date of Patent: Aug. 5, 2003

(54) OPEN TOP IC SOCKET

(75) Inventors: Hideki Sagano, Kawasaki (JP); Noriyuki Matsuoka, Yokohama (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 10/098,319

(22) Filed: Mar. 18, 2002

(65) Prior Publication Data

US 2002/0151203 A1 Oct. 17, 2002

(30) Foreign Application Priority Data

Mar. 19, 2001 (JP) ..... 2001-078655
Feb. 25, 2002 (JP) ..... 2002-048638

(51) Int. Cl.[7] ..... H01R 11/22
(52) U.S. Cl. ..... 439/268; 439/342
(58) Field of Search ..... 439/70, 71, 342, 439/259, 268, 264

(56) References Cited

U.S. PATENT DOCUMENTS 5,443,404 A * 8/1995 Matsuoka ..... 439/717
5,989,049 A * 11/1999 Walkup et al. ..... 439/342
6,045,381 A * 4/2000 Walkup et al. ..... 439/259
6,083,028 A * 7/2000 Pei et al. ..... 439/342
6,181,568 B1 * 1/2001 McHugh et al. ..... 361/760
6,200,153 B1 * 3/2001 Pei ..... 439/342
6,210,199 B1 * 4/2001 Walkup et al. ..... 439/342
6,217,362 B1 * 4/2001 Pei et al. ..... 439/342

FOREIGN PATENT DOCUMENTS

JP 4-19979 1/1992

* cited by examiner

*Primary Examiner*—Tulsidas Patel
(74) *Attorney, Agent, or Firm*—Finnegan, Henderson, Farabow, Garrett & Dunner, L.L.P.

(57) ABSTRACT

An open top IC socket according to the present invention includes a plurality of IC package mounting units each including a socket body that includes a plurality of pairs of contact sections into which terminals of an IC package are inserted and each of which is able to open and close, and each further including a slide block slidably overlapped on the socket body for opening and closing the contact sections, a socket base for containing and holding the IC package mounting units in an aligned state, a coupling member for mutually coupling the individual slide blocks of the IC package mounting units, and a block operation element mounted on the socket base for sliding the individual slide blocks in the direction of sliding of the slide blocks. According to the present invention, the mounting and detaching of the plurality of the IC packages can be achieved simultaneously.

15 Claims, 10 Drawing Sheets

OPEN TOP IC SOCKET

This application is based on Japanese Patent Application Nos. 2001-078655 filed Mar. 19, 2001 and 2002-048638 filed Feb. 25, 2002, the contents of which are incorporated hereinto by reference.

BACKGROUND OF THE INVENTION

1. Field of the Invention

The present invention relates to an open top IC socket for mounting a grid array IC package such as a BGA (Ball Grid Array), a CSP (Clip Scale Package) or a PGA (Pin Grid Array), and more particularly relates to an open top IC socket capable of attaching or detaching of a plurality of IC packages simultaneously with one operation.

2. Description of the Related Art

Upon a manufactured IC package being tested on its performance, an IC socket is interposed between an inspection board and the IC package, which IC package is thereupon adapted to be rapidly exchangeable with respect to the IC socket. A prior art open top IC socket that mounts a grid array type IC package mounts in general only one IC package thereon.

Referring to FIG. 9, such a prior art open top IC socket is illustrated in a plane view, and to FIG. 10, illustrated in a front view. The IC socket 100 comprises a socket body 101, a slide block 103 that is superimposed on the socket body 101 and includes a plurality of lines of elongated terminal insertion holes 102, into which holes pin terminals or ball like terminals formed on an IC package (not shown) are inserted, two sets of operation levers 104 and 105 for laterally moving the slide block 103 along the surface of the socket body 101, and an operation member 106 for operating these operation levers 104 and 105 by depression.

The IC socket 100 further includes a plurality of connector pins each for electrically connecting the mounted IC package and an inspection board (not shown) for inspecting the IC package. The plurality of the connector pins include a plurality of paired contact sections 107 located in the terminal insertion holes 102 for holding the terminal of the IC package, and a plurality of terminal sections 108 protruded from the socket body 101 and inserted into the inspection board. The contact section 107 is adapted such that its one side engages with the slide block 103 in the terminal insertion hole 103 and it is hereby made resiliently displaceable in the direction opposite to the other side following a lateral movement of the slide block 103.

When the IC package is mounted on the IC socket 100, a guide piece 109 formed on the operation member 106 is depressed along the guide groove 110 mechanically or manually. Pressure reception sections 111 of the operation levers 104 and 105 receive the depressing operation whereby the operation levers 104 and 105 are rotated around a lever support shaft 112 provided on the socket body 101.

Owing to the rotation motion of the operation levers 104 and 105, the slide block 103 undergoes a lateral movement in the right direction in FIG. 9 through a transmission shaft 113 against spring force provided with the contact section 107 itself. The contact section 107 of each pair is hereby opened as illustrated in FIG. 9. The IC package is positioned with respect to the slide block 103 while being guided by a guide section 114 protruded at four corners of the slide block 103, whereby terminals of the IC package go in between the contact sections 107 of the corresponding pair.

When the depressing force to the operation member 106 is released in this situation, the operation member 106 returns to the original rise end position owing to the spring force provided with the contact section 107 itself. Following this, the slide block 103 also returns to the initial position. The terminal of the IC package is thus held between the corresponding contact section 107.

When the IC package is detached from the IC socket 100, the operation member 106 is again depressed to force the slide block 103 to undergo a lateral movement through the operation levers 104 and 105 and hence open the contact sections 107 of each pair for release of the restriction of the contact sections 107 for the terminals of the IC package. Thereafter, the IC package is pulled out from the IC socket 100, whereby the IC package is detached from the IC socket 100 with ease.

Details of the opening/closing operation of the contact section 107 are disclosed in Japanese Patent Application Laid-Open No. 4-19979 (1992), etc., for example.

The prior art IC socket 100 in the type illustrated in FIGS. 9 and 10 simply mounts only one IC package for the one IC socket. This causes a difficulty that provided the IC packages are different from each other in their types, IC sockets corresponding to those types are required.

A recent trend that the number of IC packages to be checked is increased requires a need of inspecting many types of IC packages. An increase of the number of IC packages to be inspected causes a difficulty that a packaged area of the prior art IC socket is severely increased when an IC socket is mounted on an inspection board, particularly only one IC package can be mounted. There is sharply increased the time required for attaching and detaching of an IC package by manual.

SUMMARY OF THE INVENTION

It is therefore an object of the present invention to provide an open top IC socket wherein packaging density is high, and a plurality of IC packages can be simultaneously attached or detached and hence the manufacturing cost is reduced.

An open top IC socket according to the present invention is adapted such that a slide block on which an IC package is mounted and a socket body are individually brought into units, and a socket base and a slide block movement mechanism, etc., all being capable of being shared, are unified. Namely, the open top IC socket according to the present invention comprises:

- a plurality of IC package mounting units each including a socket body that includes a plurality of pairs of contact sections into which terminals of an IC package are inserted and each of which is able to open and close, and each further including a slide block slidably overlapped on the socket body for opening and closing the plurality of pairs of the contact sections;
- a socket base for containing and holding the IC package mounting units in an aligned state;
- a coupling member for mutually coupling the individual slide blocks of the IC package mounting units; and
- block operation means mounted on the socket base for sliding the individual slide blocks in the direction of sliding of the slide blocks.

When an IC package is mounted in the present invention, the block operation means is operated to slide the plurality of the slide blocks simultaneously and hence change over the contact section of each socket body to an open state. Then, after the terminal of each IC package is inserted between the opened contact sections of the corresponding socket body, the block operation means is returned to the original position to slide the plurality of the slide blocks simultaneously and hence change over the contact section of the individual socket body. Hereby, the individual terminal is held by the contact sections of the corresponding pair to establish electrical connection.

When the IC package is detached from such a connecting situation, the block operation means is again operated to slide the plurality of the slide blocks simultaneously and hence change over the contact section of the individual socket body to an open state. Hereby, restriction of the contact section to the terminal of the IC package is released, whereby the individual IC package is drawn out from the corresponding individual socket body.

In accordance with the present invention, a plurality of the IC package mounting units are assembled in one socket base, so that the size of an external appearance is more reduced than the case where a plurality of the prior art IC sockets are simply incorporated to ensure light weight thereof and reduction of the number of parts and hence reduce the manufacturing cost thereof. Further, packaging density of the IC socket with respect to the inspection board is substantially increased, so that the number of IC packages capable of being inspected is substantially increased, so that the number of IC packages capable of being inspected at a time can be set higher.

In the open top IC socket according to the present invention, the socket base may include a plurality of engaging means engaged with the individual socket bodies of the IC package mounting units for locking the socket bodies to the socket base. In case of these plurality of engaging means have a resiliently deformable locking pawl, the socket body can be securely locked to the socket base. In particular, when the plurality of engaging means have a resiliently deformable locking pawl, an exchange of the IC package mounting unit to the socket base is ensured, and the unit can be exchanged to an IC package mounting unit corresponding to the type of an IC package that is an inspection object for applications of general purposes.

The coupling member may be slidably mounted on the socket base in parallel to the direction of the sliding of the slide block. In this situation, a mechanism for sliding in a lump all slide blocks can be more simplified.

The block operation member may include an operation lever which is mounted on the socket base and to which the coupling member is coupled. In this situation, sliding of all slide blocks can be achieved with ease only by operation of the operation lever.

The each socket body of the IC package mounting units may further include a plurality of terminals each of which is protruded from the socket body and is conductive with the plurality of pairs of the contacts. In this case, the plurality of the terminals may be inserted into the plurality of pairs of contacts formed on an inspection board for inspecting an IC package. In this situation, the open top IC socket is useable for the inspection board for inspecting an IC package.

The above and other objects, effects, features and advantages of the present invention will become more apparent from the following description of embodiments thereof taken in conjunction with the accompanying drawings.

DETAILED DESCRIPTION OF PREFERRED EMBODIMENTS

In what follows, preferred embodiments of an open top IC socket according to the present invention will be described in detail with reference to FIGS. 1 to 8. The present invention is not limited only to these preferred embodiments, and any combinations thereof, and all alterations and corrections included in the concept of the present invention as claimed in the present specification. The present invention is therefore applicable to other any techniques.

Figure 1:
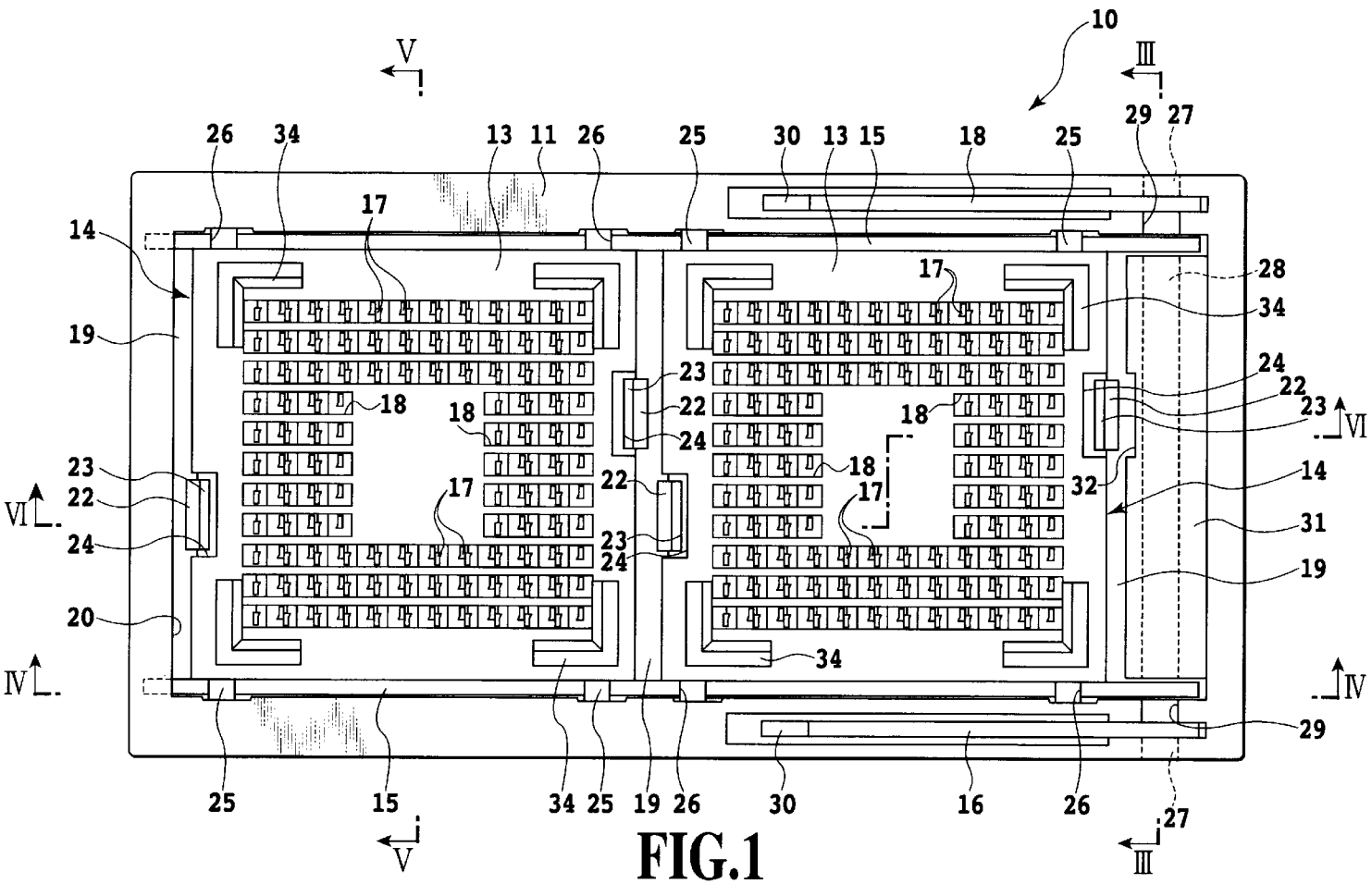
FIG. 1 is a plan view illustrating an external appearance of a preferred embodiment of an open top IC socket according to the present invention, in which a contact section is opened.
Figure 2:
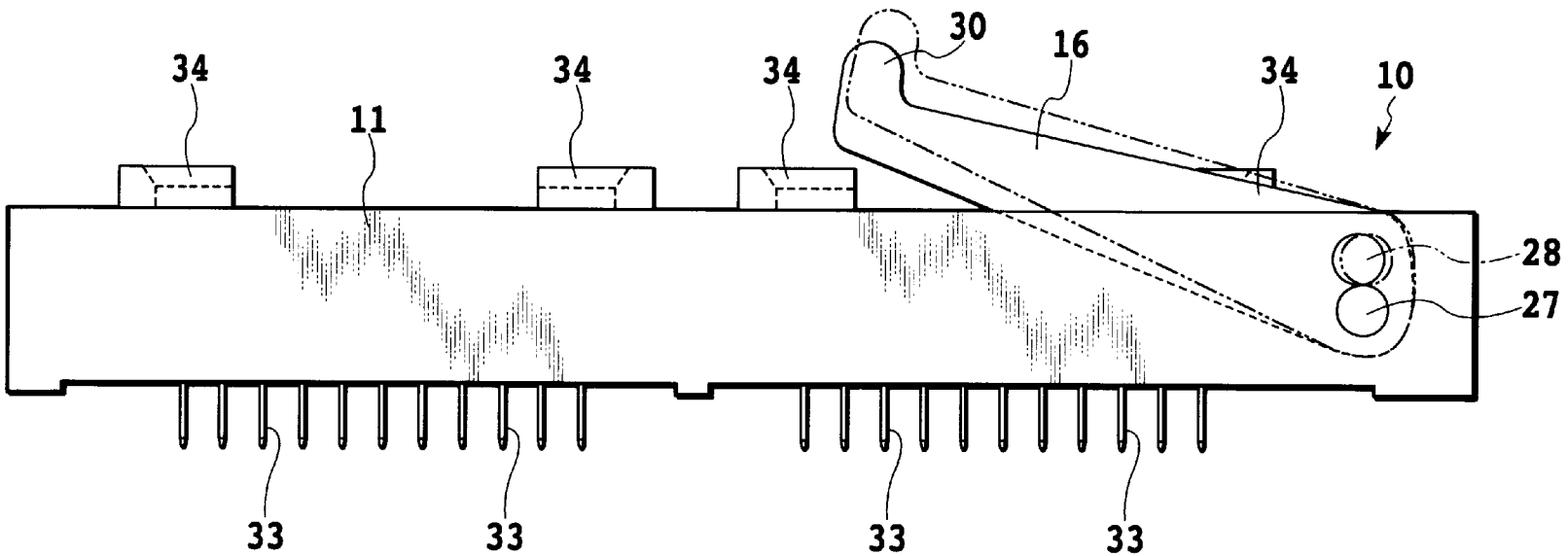
FIG. 2 is a front view of the embodiment illustrated in FIG. 1.
Figure 3:
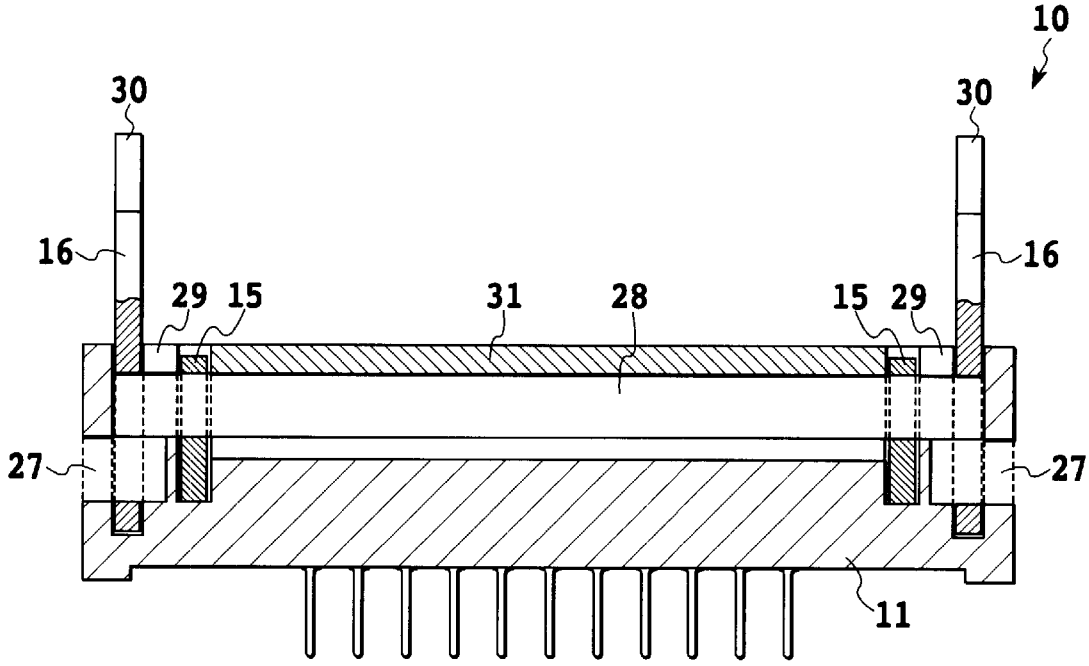
FIG. 3 is a cross sectional view indicated by an arrow taken along a line III—III in FIG. 1.
Figure 4:
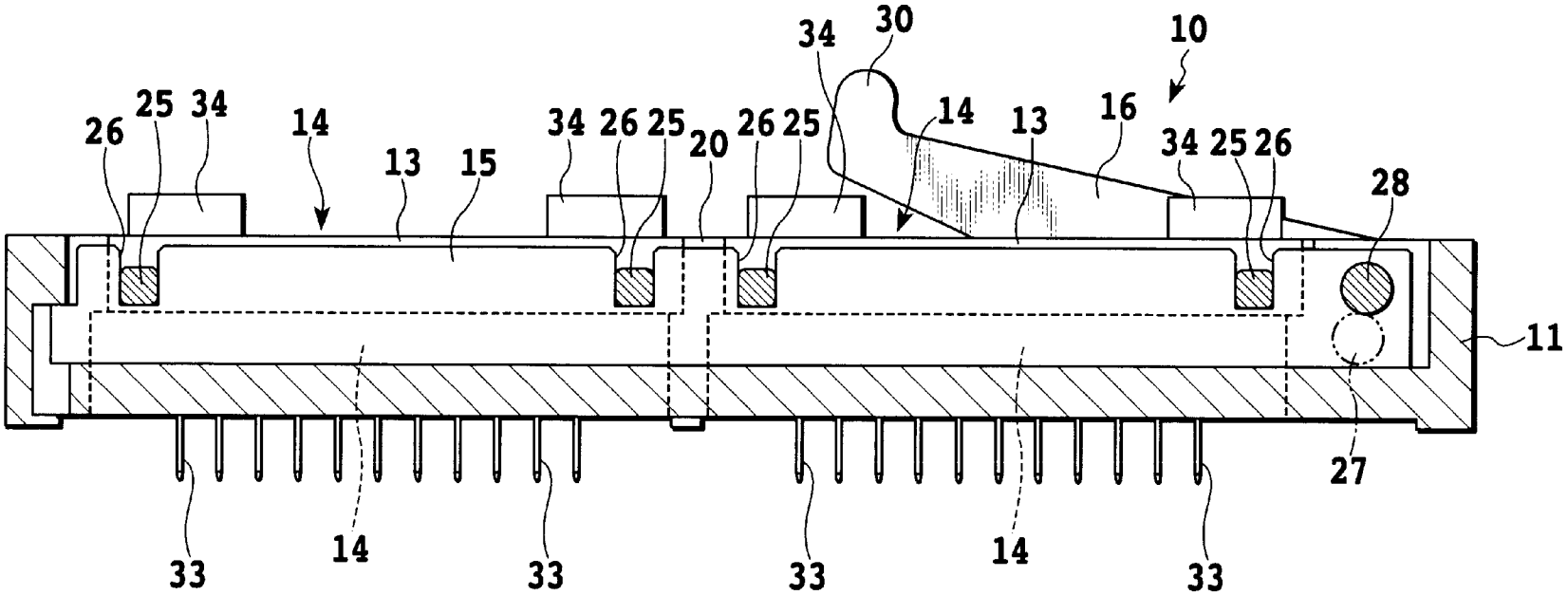
FIG. 4 is a cross sectional view taken along an arrow taken along a line IV—IV in FIG. 1.
Figure 5:
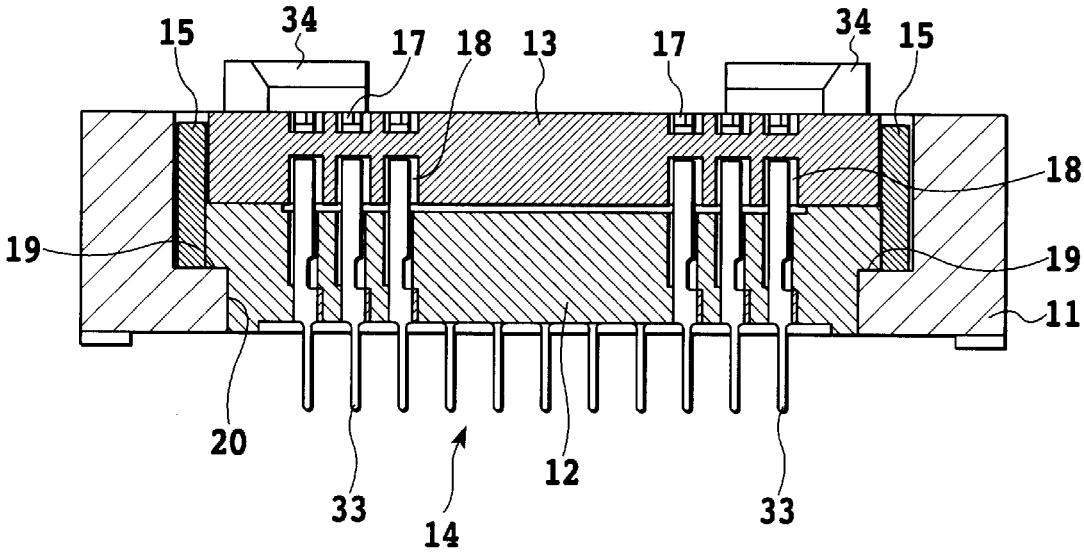
FIG. 5 is a cross sectional view taken along an arrow V—V.
Figure 6:
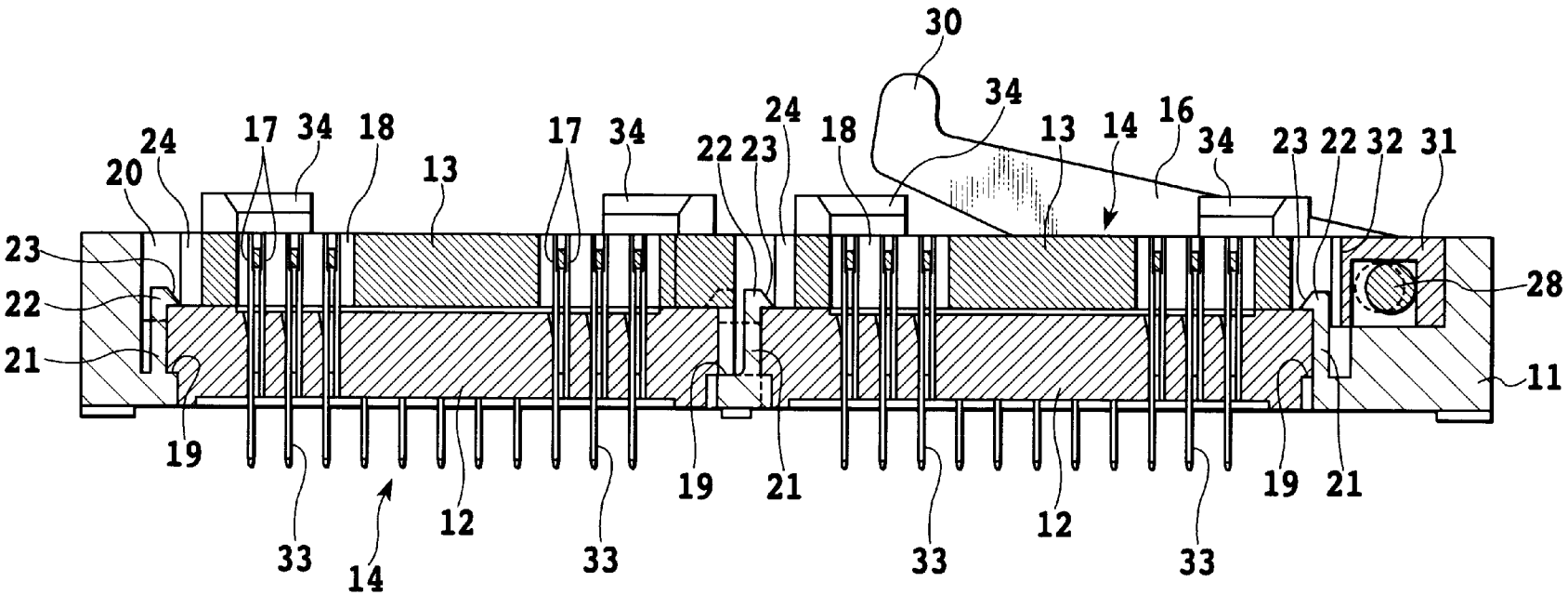
FIG. 6 is a cross sectional view taken along an arrow VI—VI in FIG. 1.

Referring to FIG. 1, an external appearance of an open top IC socket according to a first preferred embodiment on which two IC packages are mountable is illustrated in a flat plane, and referring to FIG. 2, a front configuration of the IC socket is illustrated. Referring further to FIGS. 3, 4, 5, and 6, cross sectional structures of the IC socket as viewed as indicated along an arrow III—III in FIG. 1, along an arrow IV—IV, along an arrow V—V, and along an arrow VI—VI are illustrated.

An open top IC socket 10 in the present embodiment includes a frame shaped socket base 11, two IC package mounting units 14 each including a socket body 12 and a slide block 13 slidably overlapped on the socket body 12, a pair of coupling members 15 for moving simultaneously laterally in the left and right directions in FIG. 1 each slide block 13 of each of the two IC package mounting units 14, and a pair of operation levers 16 for driving the pair of the coupling plates 15.

In the socket body 12 of each IC package mounting unit 14, an elongated terminal insertion hole 18 is formed, in which hole a plurality of pairs of contact sections 17 are able to open and close into which terminals (not shown) of an IC package are contained at a predetermined interval are inserted. The slide block 13 overlapped on the socket body 12 has a function to open and close a plurality of pairs of the contact sections 17.

An opening section 20 is formed in the socket base 11, the opening section 20 includes a shelf 19 on which the socket body 12 of the IC package mounting unit 14 is placed. On the shelf 19 of the opening section 20 facing the slide block 13 in the direction of sliding of the same resiliently deformable locking members 21 are vertically provided one by one for locking the socket body 12 of the IC package mounting unit 14. These locking members 21 serve as engaging means of the present invention respectively. The locking member 21 resiliently deformable on the side of the tip end thereof in the direction of the sliding of the slide block 13 includes a pawl 22 that engages with an upper end surface of the socket body 12 at its upper end. A slope 23 is formed on the pawl section 22, the slope 23 is to resiliently deform the locking member 21 such that it abuts an outer peripheral edge of the socket body 12 to withdraw the pawl 22 upon mounting the IC package mounting unit 14 on the opening section 20 of the socket base 11. For ensuring the engagement of the pawl section 22 with the upper end surface of the socket body 12 on which the slide block 13 is overlapped a recess 24 surrounding the pawl 22 is formed in the slide block 13.

The IC package mounting unit 14 is detachable from the socket base 11 by making the locking member 21 resiliently deformable when the engagement of the pawl 22 of the locking member 21 with the socket body 12 is released. This means the IC package mounting units 14 of different types are individually exchangeable at need with respect to the socket base 11.

The pair of the coupling plates 15, that oppose while putting the IC package mounting unit 14 to serve as the coupling member of the present invention, are slidably mounted longitudinally thereof in parallel to the direction of the sliding of the slide block 13 with respect to the socket base 11. A cutout 26 is formed in the pair of the coupling members 15, the cutout 26 engages with a plurality of coupling pins 25 each protruded on the slide block 13. Hereby, the coupling plate 15 and the slide block 13 are laterally movable in a united manner.

Into the socket base 11, base ends of the pair of the operation levers 16 are fitted rotatably with respect to a lever support shaft 27 locked to the socket base 11. To one ends of the pair of the coupling plates 15, opposite ends of a transmission shaft 28 that extends perpendicularly to the direction of the sliding of the slide block 13 are coupled in the situation where they penetrate those ends. The opposite ends of the transmission shaft 28 contained in a groove 29 formed in the socket base 11 are fitted rotatably to the pair of the operation levers 16 just above the lever support shaft 27.

The transmission shaft 28 has a function to convert the rotation operation of the pair of the operation levers 16 around the lever support shaft 27 to a lateral movement of the coupling plate 15. The transmission shaft 28 is set to displace as indicated by a long dashed double-short dashed line in the figure following the rotation operation of the operation lever 16. The aforementioned operation lever 16, lever support shaft 27, and transmission shaft 28, etc., construct the block operation means of the present invention. The pair of the levers 16 are rotated around the lever support shaft 27 by depressing the pressure receiving section 30 formed on the tip ends o the pair of the operation levers 16. This causes the pair of the coupling plates 15 to be moved in the left direction in the figure together with the slide block 13 through the transmission shaft 28. Provided the slide block 13 is laterally movable with respect to the socket body 12, it is possible to employ properly the block operation means having a construction other than the present embodiment.

Designated at 31 in the figure is a shaft cover for covering the transmission shaft 28 after the transmission shaft 28 is fallen into the groove 29. The shaft cover 31 is integrally joined with the socket base 11 after an assembly of the coupling plate 15, the operation lever 16, and the transmission shaft 28 is mounted on the socket base 11. A recess 32 is formed in a section of the shaft cover 31 that is opposed to the locking member 21 for the allowance of a resilient withdraw displacement of the locking member 21.

The aforementioned contact section 17 is provided therein spring force for energizing the pressure receiving section 30 located at the tip end of the operation lever 16 so as to push upward the same. Therefore, the contact section 17 of each pair are kept closed when no opening force is applied to the operation lever 16.

Figure 9:
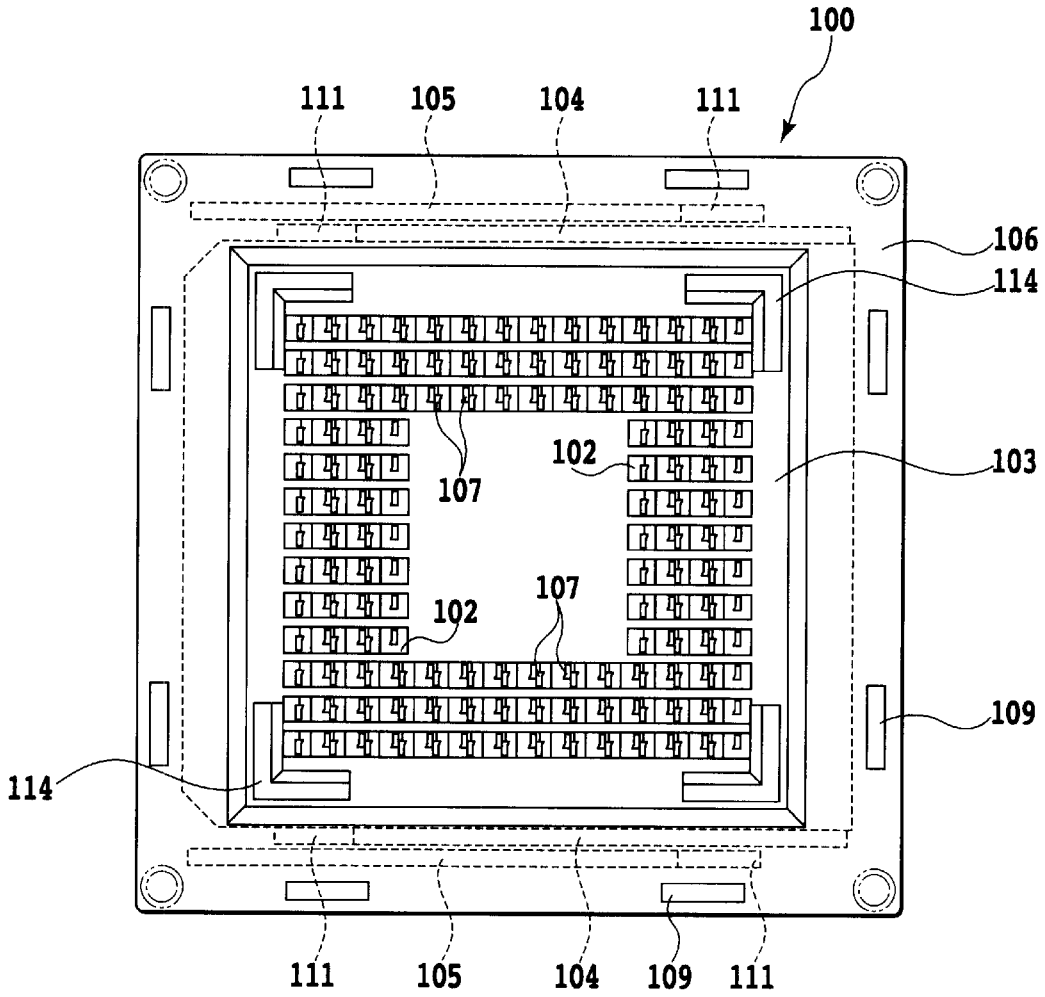
FIG.9 PRIOR ART
FIG. 9 is a plan view illustrating an example of a prior art open top IC socket.
Figure 10:
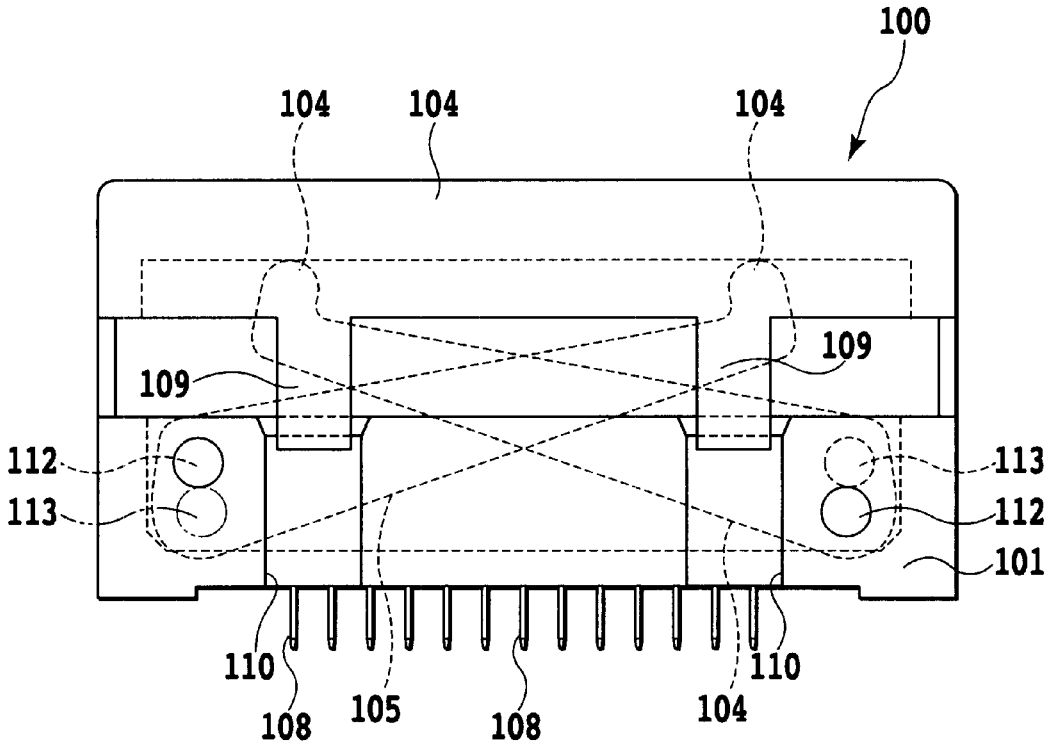
FIG.10 PRIOR ART
FIG. 10 is a front view illustrating the open top IC socket illustrated in FIG. 9.

For depressing the operation lever 16, it is also possible to assemble the operation member 106 illustrated in FIGS. 9 and 10 into the socket base 11. It is eliminated thereupon the need of the pair of the operation levers 16, and instead the operation lever 16 may be provided on any one side.

Upper ends of a plurality of connector pins mounted so as to be arranged at a predetermined interval from the terminal insertion hole 18 of the socket body 12 constitute the contact sections 17 of each pair as described above. Lower ends of these connector pins constitute a plurality of the terminal sections 33 protruded from the socket body 12. These terminal sections 33 are adapted to be inserted into contacts provided on an inspection board of an IC package (not shown).

At four corners on the upper end surface of the slide block 13, guide sections 34 for the IC package are formed respectively. It is hereby possible to accurately position the IC package with respect to the slide block 13 upon mounting the IC package on the IC package mounting unit 14.

Figure 7:
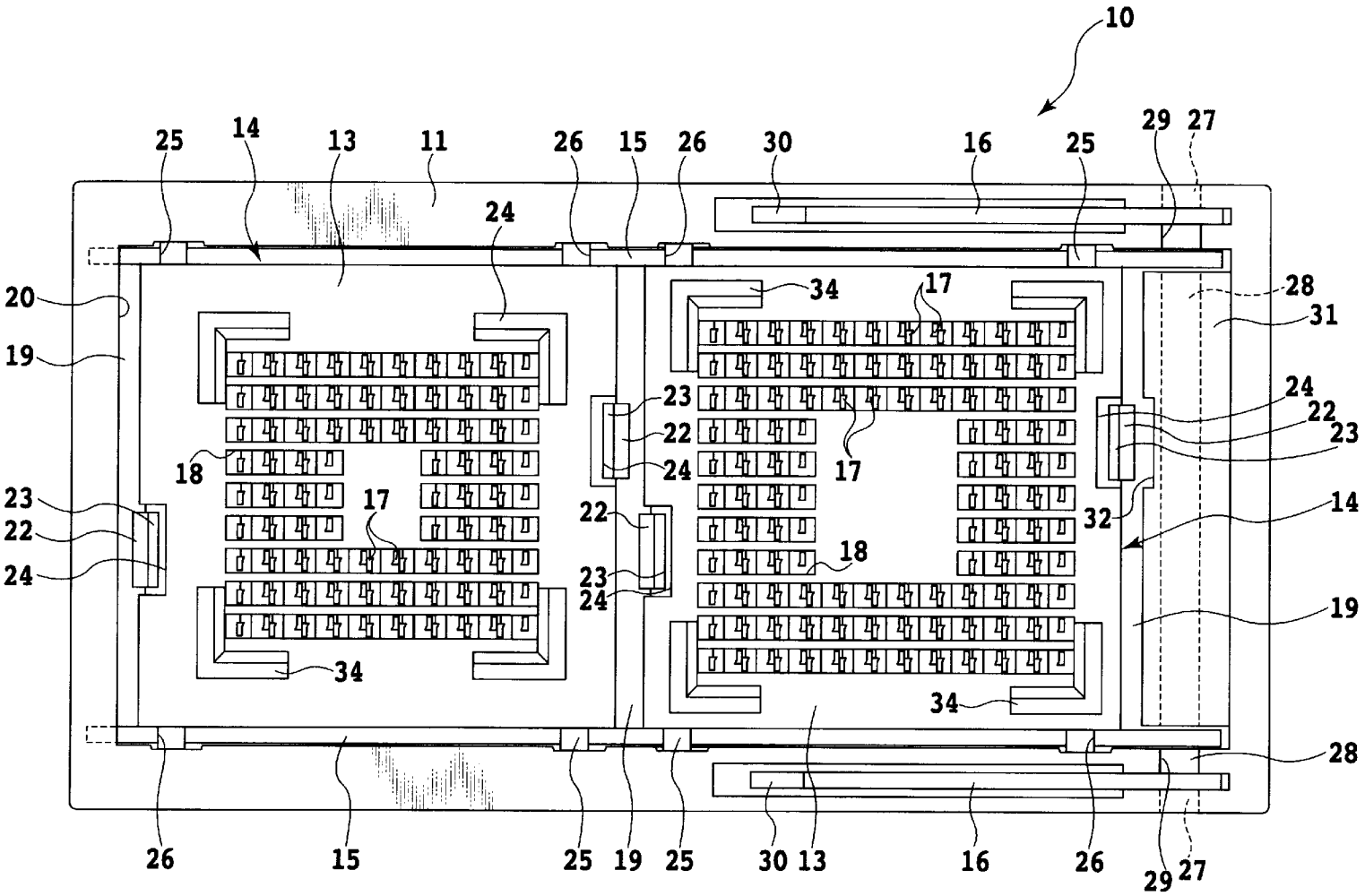
FIG. 7 is a plan view illustrating an external appearance of another embodiment of the open top IC socket according to the present invention.
Figure 8:
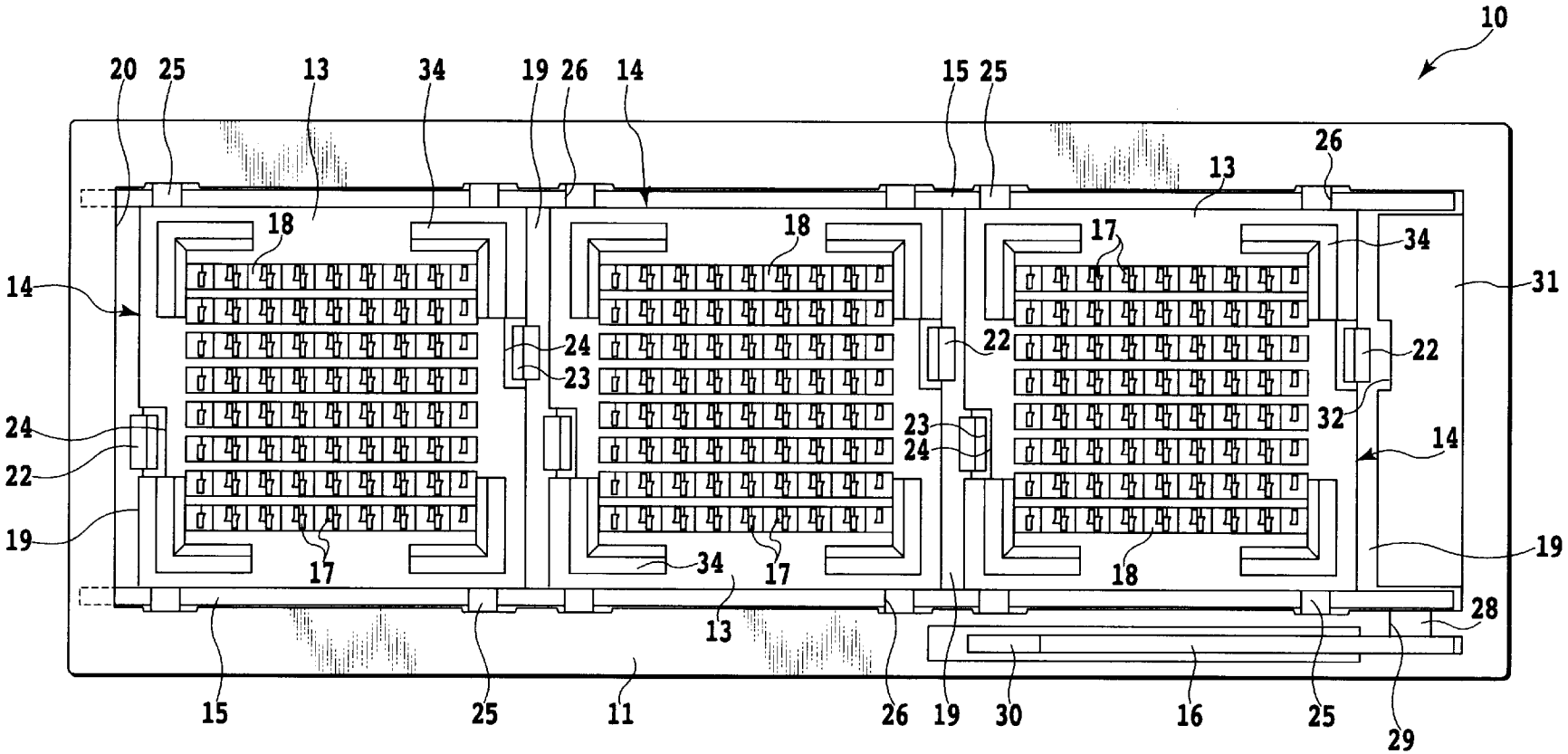
FIG. 8 is a plan view illustrating an external appearance of further another embodiment of the open top IC socket according to the present invention.

The open top IC socket 10 in the aforementioned embodiment is adapted such that the same two IC packages are mounted for the socket base 11. In the present embodiment, however, the two IC package mounting units 14 are individually detachable with respect to the socket base 11, so that it is also possible to mount an IC package mounting unit 14 of a different type corresponding to an IC package of a different type as illustrated in FIG. 7 on the socket base ll. It is further also possible to mount three or more (three in the example in the figure) of IC packet mounting units 14 of the same or mutually different types with respect to the socket base 11 such that three or more of IC packages can be mounted as illustrated in FIG. 8. In the embodiment illustrated in FIG. 8, the operation lever 8 is mounted on one side of the transmission shaft 28. In these figures, same symbols are applied to elements of the same functions as those in the previous embodiments.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An open top IC socket comprising:

a plurality of IC package mounting units each including a socket body that includes a plurality of pairs of contact sections into which terminals of an IC package are inserted and each of which is able to open and close, and each further including a slide block slidably overlapped on the socket body for opening and closing the plurality of pairs of the contact sections;

a socket base for containing and holding said IC package mounting units in an aligned state;

a coupling member for mutually coupling the individual slide blocks of said IC package mounting units; and block operation means mounted on said socket base for sliding the individual slide blocks in the direction of sliding of the slide blocks.

2. An open top IC socket as claimed in claim 1, wherein said socket base includes a plurality of engaging means engaged with the individual socket bodies of said IC package mounting units for locking the socket bodies to said socket base.

3. An open top IC socket as claimed in claim 2, wherein said plurality of engaging means include a resiliently deformable locking pawl.

4. An open top IC socket as claimed in claim 1, wherein said coupling member is slidably mounted on said socket base in parallel to the direction of the sliding of the slide block.

5. An open top IC socket as claimed in claim 2, wherein said coupling member is slidably mounted on said socket base in parallel to the direction of the sliding of the slide block.

6. An open top IC socket as claimed in claim 3, wherein said coupling member is slidably mounted on said socket base in parallel to the direction of the sliding of the slide block.

7. An open top IC socket as claimed in claim 1, wherein said block operation member includes an operation lever which is mounted on said socket base and to which said coupling member is coupled.

8. An open top IC socket as claimed in claim 2, wherein said block operation member includes an operation lever which is mounted on said socket base and to which said coupling member is coupled.

9. An open top IC socket as claimed in claim 3, wherein said block operation member includes an operation lever which is mounted on said socket base and to which said coupling member is coupled.

10. An open top IC socket as claimed in claim 1, wherein the each socket body of said IC package mounting units further includes a plurality of terminals each of which is protruded from the socket body and is conductive with the plurality of pairs of the contacts.

11. An open top IC socket as claimed in claim 2, wherein the each socket body of said IC package mounting units further includes a plurality of terminals each of which is protruded from the socket body and is conductive with the plurality of pairs of the contacts.

12. An open top IC socket as claimed in claim 3, wherein the each socket body of said IC package mounting units further includes a plurality of terminals each of which is protruded from the socket body and is conductive with the plurality of pairs of the contacts.

13. An open top IC socket as claimed in claim 10, wherein the plurality of the terminals are inserted into the plurality of pairs of contacts formed on an inspection board for inspecting an IC package.

14. An open top IC socket as claimed in claim 11, wherein the plurality of the terminals are inserted into the plurality of pairs of contacts formed on an inspection board for inspecting an IC package.

15. An open top IC socket as claimed in claim 12, wherein the plurality of the terminals are inserted into the plurality of pairs of contacts formed on an inspection board for inspecting an IC package.

* * * * *